US012680697B2

(12) United States Patent
Grigsby

(10) Patent No.: US 12,680,697 B2
(45) Date of Patent: Jul. 14, 2026

(54) MODIFIED BURN BARREL ASSEMBLY

(71) Applicant: Phil Grigsby, Milan, IN (US)

(72) Inventor: Phil Grigsby, Milan, IN (US)

( * ) Notice: Subject to any disclaimer, the term of this patent is extended or adjusted under 35 U.S.C. 154(b) by 1077 days.

(21) Appl. No.: 17/831,798

(22) Filed: Jun. 3, 2022

(65) Prior Publication Data

US 2023/0392788 A1 Dec. 7, 2023

(51) Int. Cl.
*F24B 1/191* (2006.01)
*F24B 13/00* (2006.01)

(52) U.S. Cl.
CPC ..... *F24B 1/1915* (2013.01); *F24B 13/006* (2013.01)

(58) Field of Classification Search
CPC ..... F23G 2203/403; F23G 5/24
See application file for complete search history.

(56) References Cited

U.S. PATENT DOCUMENTS 2,916 A * 1/1843 Stimpson ..... F24B 5/02 126/58
51,574 A * 12/1865 Elliot ..... F24B 5/02 44/540
69,242 A * 9/1867 Pepper ..... F24B 5/026 126/77
201,238 A * 3/1878 Gemmell ..... F24B 1/02 126/144
588,335 A * 8/1897 Hill ..... B07B 1/005 209/335
599,225 A * 2/1898 Dimmock ..... F24B 1/02 D23/343
1,349,785 A * 8/1920 Savage ..... F23G 5/24 110/253
1,648,119 A * 11/1927 Hallett ..... F23G 5/04 110/250
1,985,962 A * 1/1935 Triggs ..... F23G 5/245 110/259
2,364,286 A * 12/1944 Furlong ..... F23G 5/12 110/187
2,408,921 A * 10/1946 Esson ..... F24B 13/008 126/41 D
2,515,408 A * 7/1950 Jester ..... F23G 7/10 110/224
2,737,911 A 3/1956 Mims
3,001,487 A * 9/1961 Meyer ..... F23G 5/245 110/259
3,111,097 A * 11/1963 Dodge ..... F23G 5/24 110/240
3,330,232 A 7/1967 Wagle
(Continued)

*Primary Examiner* — David J Laux

(57) ABSTRACT

A modified burn barrel assembly for collecting and subsequently disposing of ashes from a burn barrel includes a burn barrel that is comprised of a fire resistant material thereby facilitating the burn barrel to contain burning fuel. The burn barrel has a bottom end that is open thereby facilitating ash to fall through the bottom end. A stand is positionable on a horizontal support surface and a plurality of support brackets is strategically arranged on the stand to facilitate the burn barrel to be stood upon the plurality of support brackets. A drawer is slidably disposed in the stand and the drawer is positionable in a closed position thereby facilitating ash from the burn barrel to be collected in the drawer. The drawer is positionable in an opened position thereby facilitating the ash to be emptied from the drawer.

6 Claims, 4 Drawing Sheets

(56) References Cited

U.S. PATENT DOCUMENTS

| | | | | |
|---|---|---|---|---|
| 3,421,495 | A * | 1/1969 | Winegardner | F24B 1/1915 126/555 |
| 3,455,291 | A | 7/1969 | Glass | |
| 5,347,935 | A | 9/1994 | Whitaker | |
| 9,618,202 | B2 * | 4/2017 | Lubanowski | F23G 5/40 |
| 10,240,782 | B1 * | 3/2019 | Powell | F23G 5/40 |
| D854,870 | S | 7/2019 | Graves | |
| 10,865,984 | B1 * | 12/2020 | Edens | F23G 5/42 |
| 11,236,905 | B1 * | 2/2022 | Holman-Thompson | F23G 5/448 |
| 2014/0261374 | A1 * | 9/2014 | Lubanowski | F23G 5/002 126/224 |
| 2015/0345797 | A1 * | 12/2015 | Lehet | F23B 10/02 126/77 |
| 2018/0317706 | A1 * | 11/2018 | Graves | A47J 37/0718 |
| 2019/0313851 | A1 * | 10/2019 | Shemp | A47J 37/0718 |
| 2022/0090791 | A1 * | 3/2022 | Hwang | F24B 3/00 |

* cited by examiner

MODIFIED BURN BARREL ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to burn barrel devices and more particularly pertains to a new burn barrel device for collecting and subsequently disposing of ashes from a burn barrel. The device includes a burn barrel with an open bottom end and a mesh screen disposed in the burn barrel to facilitate ash to fall through the burn barrel. The device includes a stand upon which the burn barrel can be positioned and a drawer that is slidably disposed in the stand for collecting the ashes that fall through the mesh screen. The drawer can be opened to empty the ashes from the drawer.

(2) Description of Related Art Including Information Disclosed Under 37 CFR 1.97 and 1.98

The prior art relates to burn barrel devices including an incinerator that includes a burn barrel with a bottom end, a grate in the burn barrel and a cart upon which the burn barrel is positioned. The prior art discloses a trash burning device that includes a burn cylinder which has an inner sleeve and an outer sleeve, a grate positioned in the burn cylinder and a pair of wheels rotatably disposed on the burn cylinder. The prior art discloses a variety of incinerator devices that each includes a burn barrel and a grate disposed within the burn barrel. The prior art discloses a burn barrel device that includes a burn barrel and a foraminous sleeve that is inserted into the burn barrel.

(h) BRIEF SUMMARY OF THE INVENTION

An embodiment of the disclosure meets the needs presented above by generally comprising a burn barrel that is comprised of a fire resistant material thereby facilitating the burn barrel to contain burning fuel. The burn barrel has a bottom end that is open thereby facilitating ash to fall through the bottom end. A stand is positionable on a horizontal support surface and a plurality of support brackets is strategically arranged on the stand to facilitate the burn barrel to be stood upon the plurality of support brackets. A drawer is slidably disposed in the stand and the drawer is positionable in a closed position thereby facilitating ash from the burn barrel to be collected in the drawer. The drawer is positionable in an opened position thereby facilitating the ash to be emptied from the drawer.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
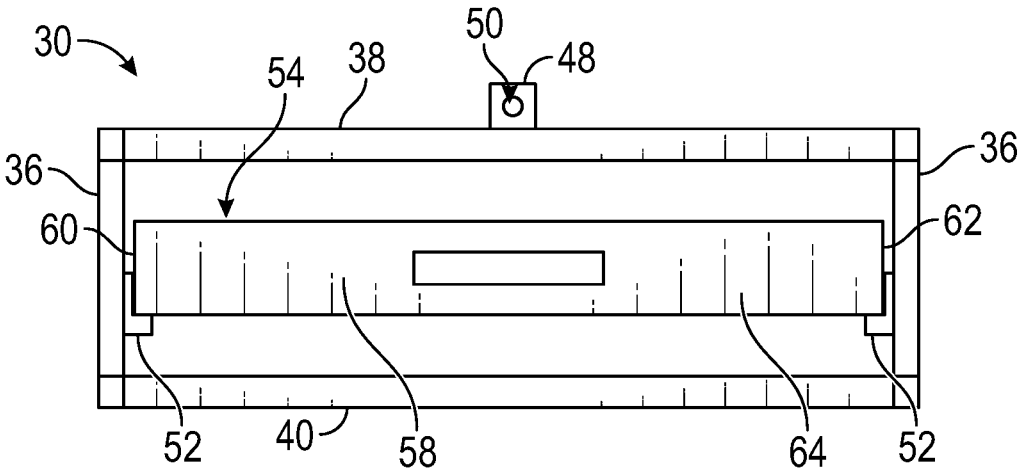
FIG. 1 is a front view of a stand of a modified burn barrel assembly according to an embodiment of the disclosure.
Figure 2:
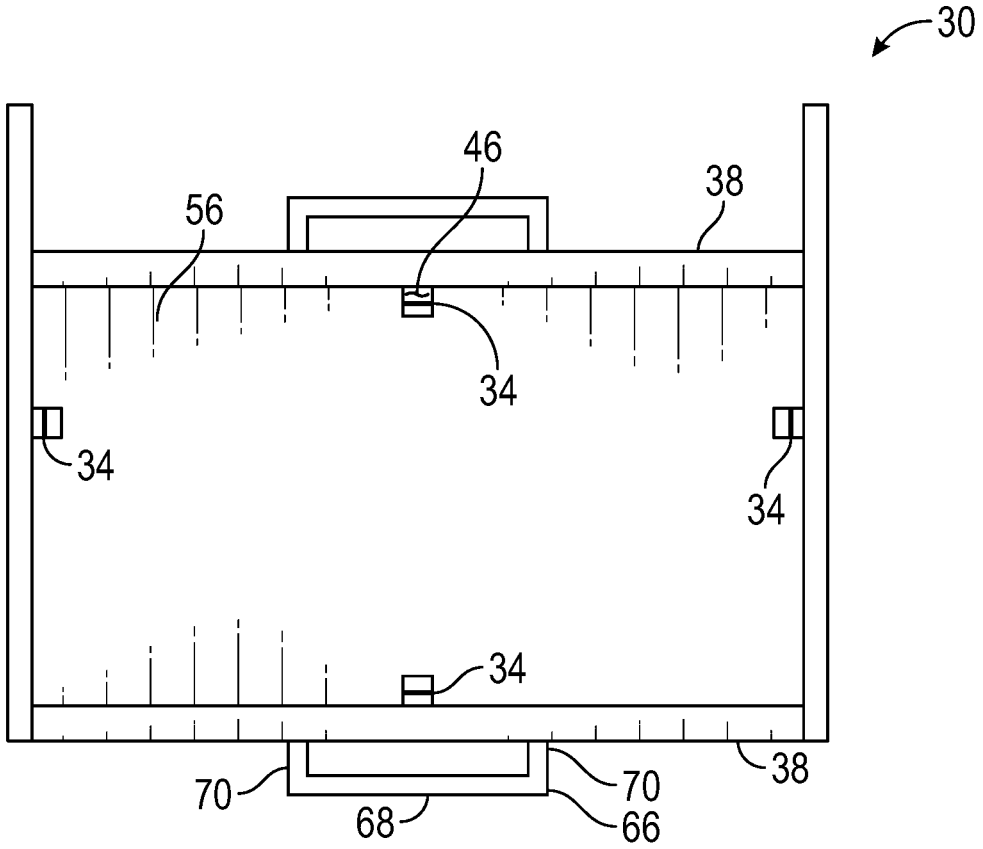
FIG. 2 is a top view of a stand of an embodiment of the disclosure.
Figure 3:
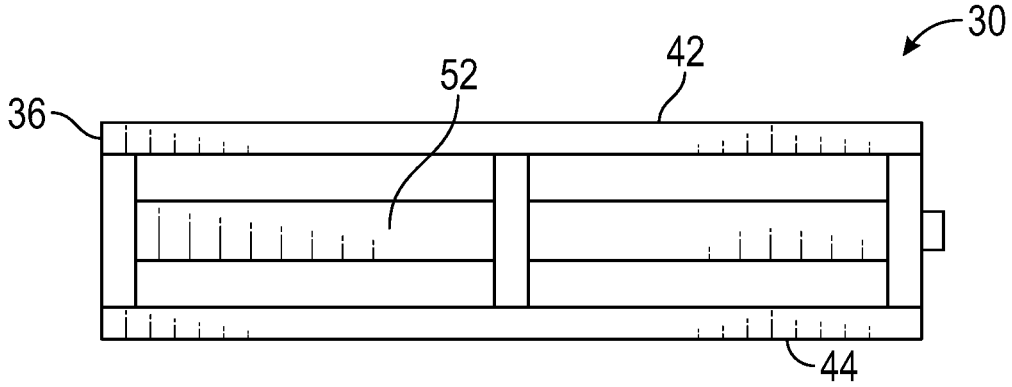
FIG. 3 is a right side view of a stand of an embodiment of the disclosure.
Figure 4:
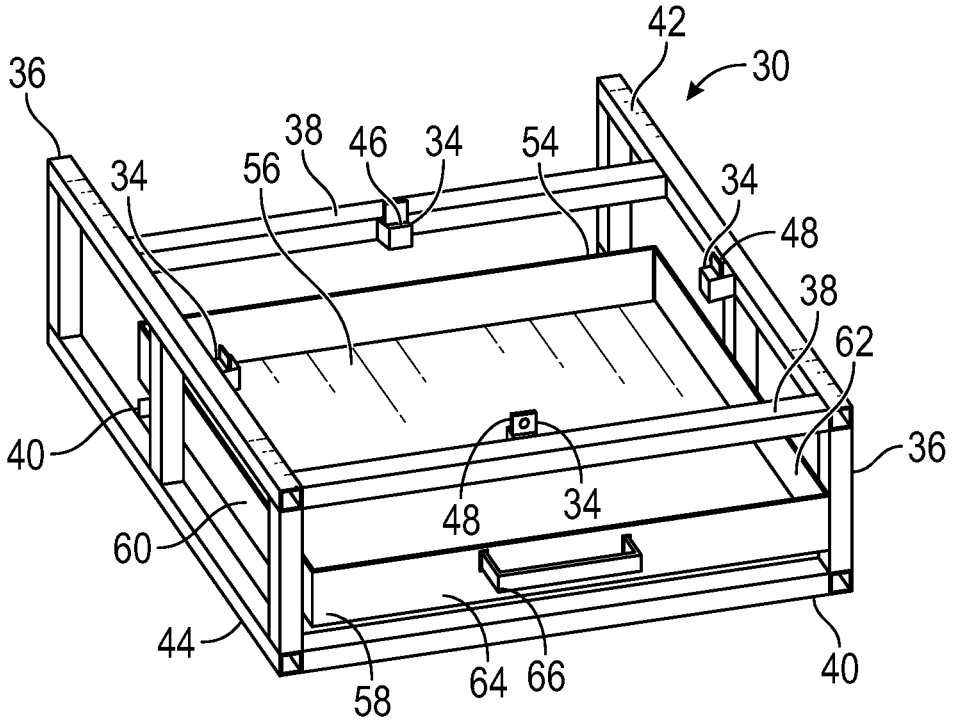
FIG. 4 is a top perspective view of a stand of an embodiment of the disclosure.
Figure 5:
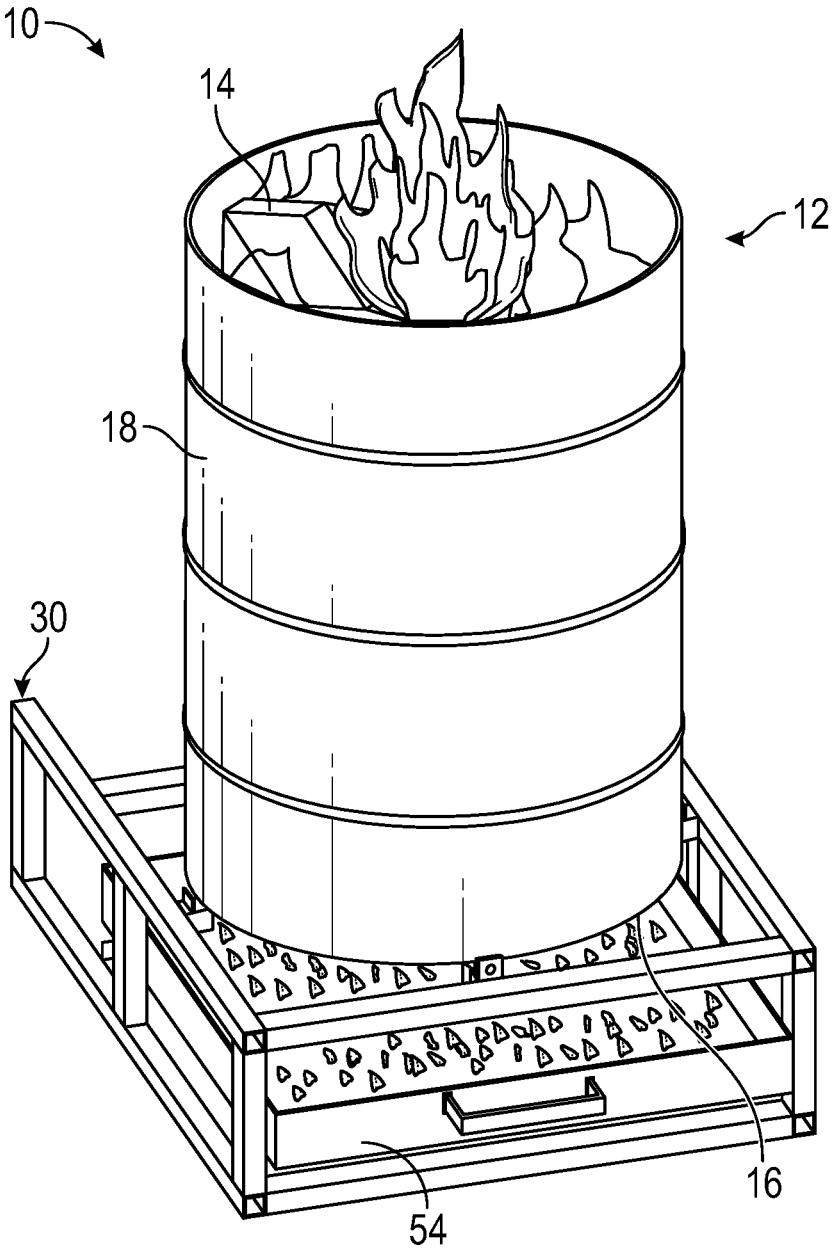
FIG. 5 is a perspective in-use view of an embodiment of the disclosure.
Figure 6:
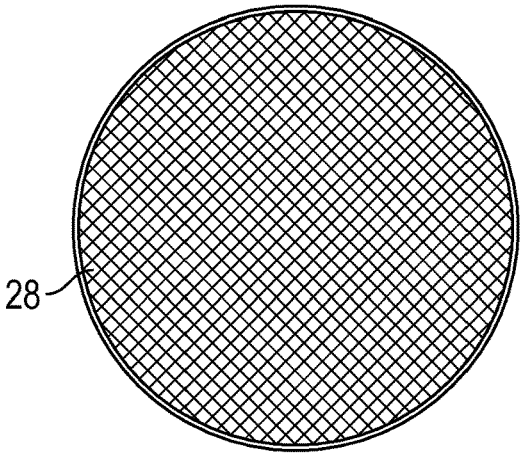
FIG. 6 is a front view of a screen of an embodiment of the disclosure.
Figure 7:
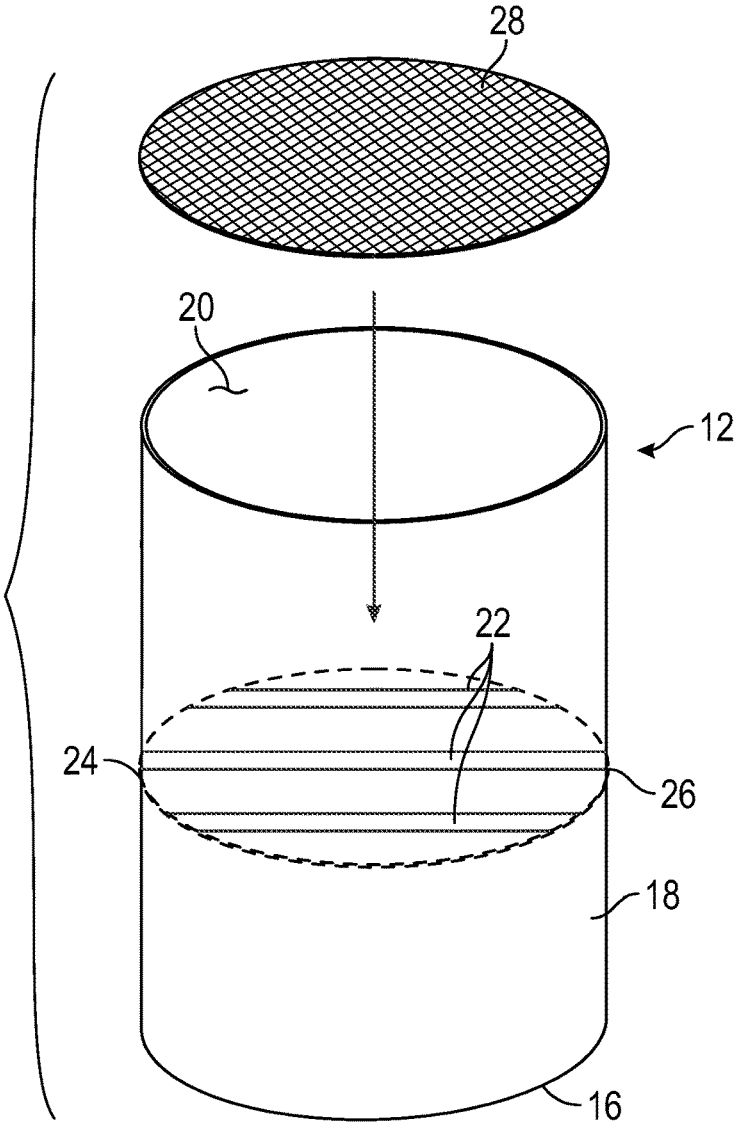
FIG. 7 is an exploded perspective view of a burn barrel of an embodiment of the disclosure.

With reference now to the drawings, and in particular to FIGS. 1 through 7 thereof, a new burn barrel device embodying the principles and concepts of an embodiment of the disclosure and generally designated by the reference numeral 10 will be described.

As best illustrated in FIGS. 1 through 7, the modified burn barrel assembly 10 generally comprises a burn barrel 12 that is comprised of a fire resistant material thereby facilitating the burn barrel 12 to contain burning fuel 14. The burning fuel 14 may be wood, household garbage or other combustible material that is commonly burned in a burn barrel 12. The burn barrel 12 has a bottom end 16 that is open thereby facilitating ashes 17 to fall through the bottom end 16. Additionally, the burn barrel 12 has an outer wall 18 and the outer wall 18 has an inside surface 20. The burn barrel 12 may have dimensions that are common to a fifty gallon drum or other similar container.

The burn barrel 12 includes a plurality of members 22 that each has first end 24 and a second end 26, and the first end 24 and the second end 26 of each of the members 22 is coupled to the inside surface 20 of the outer wall 18. Each of the members 22 is oriented to lie on a plane that is oriented coplanar with the bottom end 16 of the burn barrel 12. The plurality of members 22 is evenly spaced apart from each other and each of the members 22 is spaced from the bottom end 16. A screen 28 is positionable on the members 22 such that the screen 28 supports the burning fuel 14 in the barrel 12. Furthermore, the screen 28 is comprised of a mesh material thereby facilitating ashes 17 from the burning fuel 14 to pass through the screen 28.

A stand 30 is provided and the stand 30 is positionable on a horizontal support surface 32. The stand 30 has a plurality of support brackets 34 and the plurality of support brackets 34 is strategically arranged to facilitate the burn barrel 12 to be stood upon the plurality of support brackets 34. The stand 30 comprises a pair of side frames 36, a pair of upper members 38 and a pair of lower members 40, and each of the upper members 38 and each of the lower members 40 extends between the pair of side frames 36 such that the stand 30 has a cubic shape. Each of the upper members 38 extends between a top 42 of the side frames 36 and each of the lower members 40 extending between a bottom 44 of the side frames 36.

Each of the support brackets 34 is coupled to a respective one of the upper members 38 and the top 42 of a respective one of the side frames 36. The plurality of support brackets 34 is arranged such that each of the support brackets 34 defines a respective corner of a diamond shape. Each of the support brackets 34 has an upper surface 46 and the bottom end 16 of the burn barrel 12 rests on the upper surface 46 of each of the support brackets 34. Each of the support brackets 34 has a panel 48 extending upwardly from the upper surface 46 and the panel 48 on each of the support brackets 34 has a fastener hole 50 extending through the panel 48. In this way a fastener, such as a screw or the like, can be extended through the fastener hole 50 and engage the outer wall 18 of the burn barrel 12 to retain the burn barrel 12 on the support brackets 34.

A pair of slides 52 is provided and each of the slides 52 is integrated into a respective one of the side frames 36. Each of the slides 52 is oriented to extend along a line that is oriented parallel with the top 42 of the respective side frame 36. Additionally, each of the slides 52 may comprise a drawer rail or other type of mechanical slide that facilitates linear motion. A drawer 54 is provided and the drawer 54 is slidably disposed in the stand 30. The drawer 54 is positionable in a closed position having the drawer 54 being positioned beneath the burn barrel 12 when the burn barrel 12 is positioned on the stand 30. In this way the ashes 17 from the burn barrel 12 can be collected in the drawer 54. Conversely, the drawer 54 is positionable in an opened position having the drawer 54 extending outwardly from the stand 30 thereby facilitating the ashes 17 to be emptied from the drawer 54.

The drawer 54 has a bottom wall 56 and an outer wall 58 extending upwardly from the bottom wall 56. The outer wall 58 of the drawer 54 has a first lateral side 60, a second lateral side 62 and a front side 64, and each of the first lateral side 60 and the second lateral side 62 slidably engages a respective one of the slides 52 on the pair of side frames 36. The bottom wall 56 is positioned beneath each of the support brackets 34 when the drawer 54 is positioned in the closed position. Additionally, the drawer 54 is comprised of a fire resistant material thereby facilitating the drawer 54 to contain the ashes 17 without catching fire. A handle 66 is provided which has a central member 68 extending between a pair of outward members 70. Each of the outward members 70 is coupled to the front side 64 of the outer wall 18 of the drawer 54 having the central member 68 being spaced from the front side 64 thereby facilitating the central member 68 to be gripped for opening and closing the drawer 54.

In use, the burn barrel 12 is positioned on each of the support brackets 34, the burn barrel 12 is secured to the panel 48 on each of the support brackets 34 and the screen 28 is placed on top 42 of the members 22 in the burn barrel 12. The burning fuel 14 is burned in the burn barrel 12 and the ashes 17 from the burning fuel 14 falls through the screen 28 and into the drawer 54. In this way the burning fuel 14 has a constant supply of oxygen through the bottom end 16 of the burn barrel 12 as well as facilitating the ashes 17 to be captured in the drawer 54. The drawer 54 can be opened at any time to facilitate the ashes 17 to be emptied from the drawer 54.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modified burn barrel assembly for collecting and subsequently emptying ash from a burn barrel, said assembly comprising:

a burn barrel being comprised of a fire resistant material thereby facilitating said burn barrel to contain burning fuel, said burn barrel having a bottom end being open thereby facilitating ash to fall through said bottom end;

a stand being positionable on a horizontal support surface, said stand having a plurality of support brackets, said plurality of support brackets being strategically arranged to facilitate said burn barrel to be stood upon said plurality of support brackets;

a drawer being slidably disposed in said stand, said drawer being positionable in a closed position having said drawer being positioned beneath said burn barrel when said burn barrel is positioned on said stand thereby facilitating ash from said burn barrel to be collected in said drawer, said drawer being positionable in an opened position having said drawer extending outwardly from said stand thereby facilitating the ash to be emptied from said drawer;

said burn barrel has an outer wall, said outer wall having an inside surface, said burn barrel having a plurality of members each having first end and a second end, said first end and said second end of each of said members being coupled to said inside surface of said outer wall, each of said members being oriented to lie on a plane oriented coplanar with said bottom end of said burn barrel, said plurality of members being evenly spaced apart from each other, each of said members being spaced from said bottom end;

said assembly includes a screen being positionable on said members such that said screen supports the burning fuel in said barrel, said screen being comprised of a mesh material thereby facilitating ash from the burning fuel to pass through said screen;

wherein said stand comprises a pair of side frames and a pair of upper members and a pair of lower members, each of said upper members and each of said lower members extending between said pair of side frames such that said stand has a cubic shape, each of said upper members extending between a top of said side frames, each of said lower members extending between a bottom of said side frames; and wherein each of said support brackets is coupled to a respective one of said upper members and said top of a respective one of said side frames, said plurality of support brackets being arranged such that each of said support brackets defines a respective corner of a diamond shape, each of said support brackets having an upper surface, said bottom end of said burn barrel resting on said upper surface of each of said support brackets.

2. The assembly according to claim 1, wherein each of said support brackets has a panel extending upwardly from said upper surface, said panel on each of said support brackets having a fastener hole extending through said panel thereby facilitating a fastener to extend through said fastener hole and engage said outer wall of said burn barrel to retain said burn barrel on said support brackets.

3. The assembly according to claim 1, further comprising a pair of slides, each of said slides being integrated into a respective one of said side frames, each of said slides being oriented to extend along a line being oriented parallel to said top of said respective side frame.

4. The assembly according to claim 3, wherein said drawer has a bottom wall and an outer wall extending upwardly from said bottom wall, said outer wall having a first lateral side, a second lateral side and a front side, each of said first lateral side and said second lateral side slidably engaging a respective one of said slides on said pair of side frames, said bottom wall being positioned beneath each of said support brackets when said drawer is positioned in said closed position.

5. The assembly according to claim 4, further comprising a handle having a central member extending between a pair of outward members, each of said outward members being coupled to said front side of said outer wall of said drawer having said central member being spaced from said front side thereby facilitating said central member to be gripped for opening and closing said drawer.

6. A modified burn barrel assembly for collecting and subsequently emptying ash from a burn barrel, said assembly comprising:

a burn barrel being comprised of a fire resistant material thereby facilitating said burn barrel to contain burning fuel, said burn barrel having a bottom end being open thereby facilitating ash to fall through said bottom end, said burn barrel having an outer wall, said outer wall having an inside surface, said burn barrel having a plurality of members each having first end and a second end, said first end and said second end of each of said members being coupled to said inside surface of said outer wall, each of said members being oriented to lie on a plane oriented coplanar with said bottom end of said burn barrel, said plurality of members being evenly spaced apart from each other, each of said members being spaced from said bottom end;

a screen being positionable on said members such that said screen supports the burning fuel in said barrel, said screen being comprised of a mesh material thereby facilitating ash from the burning fuel to pass through said screen;

a stand being positionable on a horizontal support surface, said stand having a plurality of support brackets, said plurality of support brackets being strategically arranged to facilitate said burn barrel to be stood upon said plurality of support brackets, said stand comprising a pair of side frames and a pair of upper members and a pair of lower members, each of said upper members and each of said lower members extending between said pair of side frames such that said stand has a cubic shape, each of said upper members extending between a top of said side frames, each of said lower members extending between a bottom of said side frames, each of said support brackets being coupled to a respective one of said upper members and said top of a respective one of said side frames, said plurality of support brackets being arranged such that each of said support brackets defines a respective corner of a diamond shape, each of said support brackets having an upper surface, said bottom end of said burn barrel resting on said upper surface of each of said support brackets, each of said support brackets having a panel extending upwardly from said upper surface, said panel on each of said support brackets having a fastener hole extending through said panel thereby facilitating a fastener to extend through said fastener hole and engage said outer wall of said burn barrel to retain said burn barrel on said support brackets;

a pair of slides, each of said slides being integrated into a respective one of said side frames, each of said slides being oriented to extend along a line being oriented parallel with said top of said respective side frame; and a drawer being slidably disposed in said stand, said drawer being positionable in a closed position having said drawer being positioned beneath said burn barrel when said burn barrel is positioned on said stand thereby facilitating ash from said burn barrel to be collected in said drawer, said drawer being positionable in an opened position having said drawer extending outwardly from said stand thereby facilitating the ash to be emptied from said drawer, said drawer having a bottom wall and an outer wall extending upwardly from said bottom wall, said outer wall having a first lateral side, a second lateral side and a front side, each of said first lateral side and said second lateral side slidably engaging a respective one of said slides on said pair of side frames, said bottom wall being positioned beneath each of said support brackets when said drawer is positioned in said closed position; and a handle having a central member extending between a pair of outward members, each of said outward members being coupled to said front side of said outer wall of said drawer having said central member being spaced from said front side thereby facilitating said central member to be gripped for opening and closing said drawer.

* * * * *